United States Patent [19]

Lendl

[11] Patent Number: 4,553,861

[45] Date of Patent: Nov. 19, 1985

[54] CONTROL SYSTEM FOR THERMAL PRINTING TYPEWRITERS OR LIKE MACHINES

[75] Inventor: Joseph Lendl, Ottensoos, Fed. Rep. of Germany

[73] Assignee: Triumph-Adler Aktiengesellschaft fur Buro-Informationstechnik, Nurnberg, Fed. Rep. of Germany

[21] Appl. No.: 582,379

[22] Filed: Feb. 22, 1984

[30] Foreign Application Priority Data

Mar. 2, 1983 [DE] Fed. Rep. of Germany ..... 3307286

[51] Int. Cl.[4] ..... B41J 3/20

[52] U.S. Cl. ..... 400/120; 346/76 PH; 219/216

[58] Field of Search ..... 400/120; 346/76 PH; 219/216

[56] References Cited

U.S. PATENT DOCUMENTS

| | | | |
|---|---|---|---|
| 3,295,394 | 1/1967 | Whateley | 74/785 X |
| 3,370,486 | 2/1968 | Lamburn | 74/781 R X |
| 3,810,192 | 5/1974 | Okabe | 346/76 PH X |
| 4,039,065 | 8/1977 | Seki et al. | 346/76 PH X |
| 4,151,397 | 4/1979 | Boor, Jr. et al. | 400/120 X |
| 4,329,075 | 5/1982 | Applegate et al. | 400/120 X |
| 4,414,862 | 11/1983 | Svab | 74/785 X |

FOREIGN PATENT DOCUMENTS

| | | | |
|---|---|---|---|
| 0054664 | 6/1982 | European Pat. Off. | 400/120 |
| 0140393 | 2/1980 | Fed. Rep. of Germany | 346/76 PH |
| 0009443 | 1/1977 | Japan | 400/120 |
| 0027380 | 3/1981 | Japan | 400/120 |
| 0033971 | 4/1981 | Japan | 400/120 |
| 0062184 | 5/1981 | Japan | 400/120 |

OTHER PUBLICATIONS

IBM Tech. Disc. Bulletin, "Ribbon Drive", Darwin, D. P., vol. 19, No. 4, Sep. 1976, pp. 1407–1408.

IBM Tech. Disc. Bulletin, "Thermal Print Head Suspension", Schweighs et al., vol. 21, No. 12, May 1979, pp. 4959–4960.

IBM Tech. Disc. Bulletin, "Ribbon Feed Mechanism", Breski et al., vol. 22, No. 7, Dec. 1979, pp. 2710–2711.

*Primary Examiner*—Edgar S. Burr
*Assistant Examiner*—James R. McDaniel
*Attorney, Agent, or Firm*—Joseph R. Spalla

[57] ABSTRACT

A typewriter having a thermal print head defining an array of print elements and a thermal print ribbon, both of which are supported on a carriage movable relative to a platen, is provided with a control system which responds to a character print command to move the print head into controlled pressure contact with the platen and to engage a substantially play free clutch for coupling carriage movement initiated by a print command to advance ribbon opposite the direction of carriage movement whereby relative movement between said ribbon and platen is avoided during printing.

5 Claims, 1 Drawing Figure

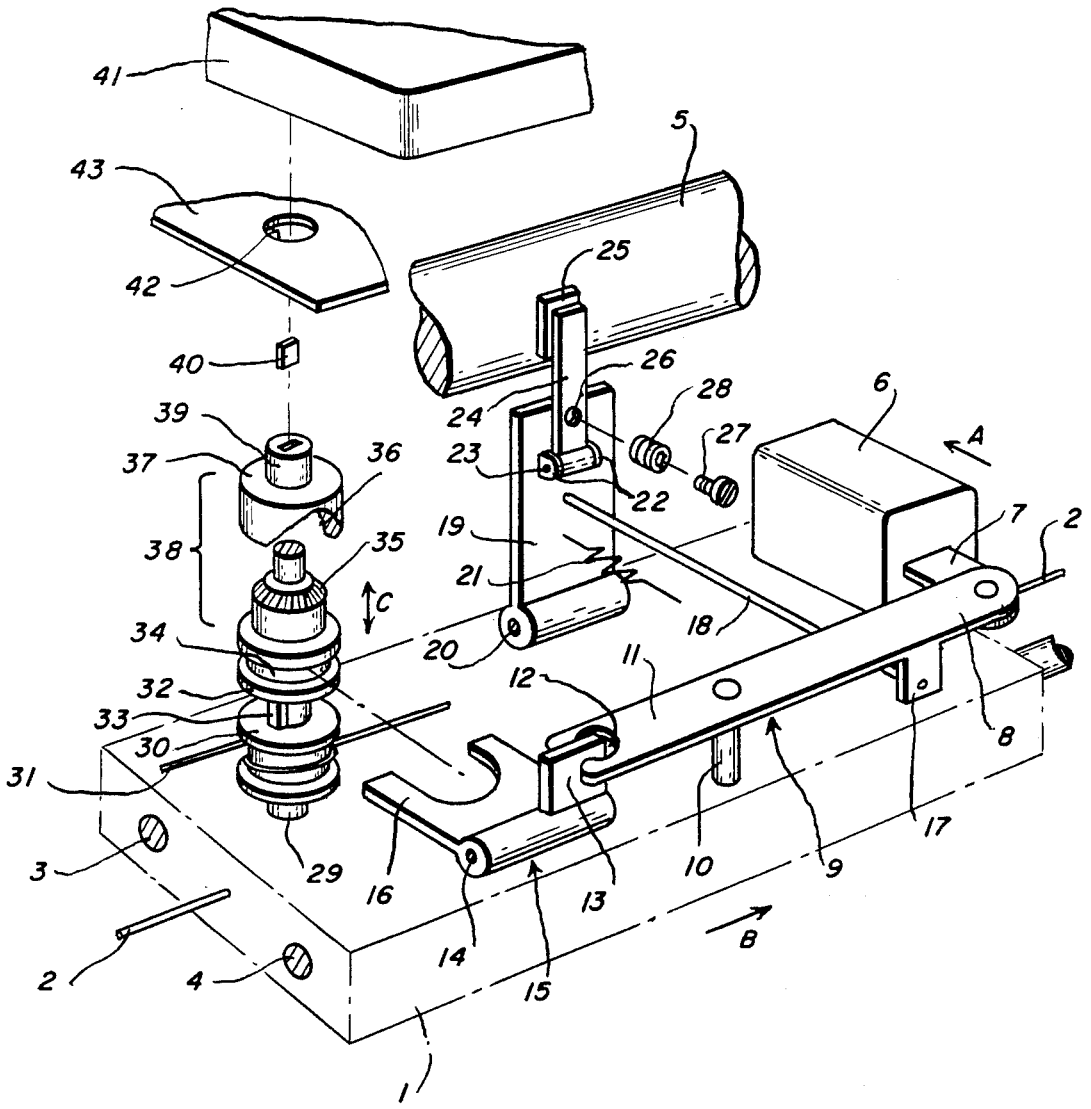
41
43
42
40
39
37
36
38
35
34
32
33
30
31
3
2
4
29
16
14
15
13
10
9
17
8
11
12
1
B
C
A
5
25
26
24
28
27
23
22
19
21
20
18
6
7
2

CONTROL SYSTEM FOR THERMAL PRINTING TYPEWRITERS OR LIKE MACHINES

This invention relates to typewriters or like machines having thermal printheads defining an array of heating elements adapted to be selectively energized in timed relationship to the columnwise movement of a supporting carriage along a print line to thereby correspondingly heat a thermal ribbon to effect transfer of ink to a recording element; more particularly, it relates to a control system having means for simultaneously causing movement of the printhead into controlled pressure contact with a platen to press therebetween the thermal print ribbon and a recording medium, and movement of a clutch actuator to engage a clutch for coupling carriage movement to ribbon advance mechanism to preclude relative movement between said ribbon and recording medium during printing.

In thermal printing typewriters employing thermal transfer ribbons it is necessary that the heat generating elements of a thermal print head bear with a certain contact pressure against a platen to press therebetween a thermal print ribbon and a recording medium whereby heated material on the ribbon may transfer to the recording medium. To avoid smearing of the print on the recording medium relative movement between the ribbon and recording medium must be avoided. Also to avoid smearing and to economize ribbon use it is customary to retract the thermal print head away from the platen during carriage return movements.

DE-OS No. 25 06 892, corresponding to U.S. Pat. No. 3,989,131 to Knirsch et al, discloses a thermal printing typewriter wherein the entire carriage and guide structure are biased by a spring to urge a print head immovably supported on the carriage into contact with a platen. Thus to retract the print head during carriage return requires movement of considerable mass. This reference further discloses ribbon mechanism mounted on the machine frame which is advanced during carriage return by an amount equal to a line of print. This arrangement precludes practical use of ribbon cartridges.

DE-OS No. 23 15 226, corresponding to U.S. Pat. No. 3,855,448 to Hanagata et al, also discloses a thermal printing typewriter wherein the thermal print head is immovably mounted on the carriage which together with its guide structure is bodily biased by a spring to bring the print head into contact with a platen. This reference discloses a ribbon system mounted on the carriage which is driven through a one-way clutch by carriage movement to avoid relative movement between ribbon and paper during printing. As a one-way clutch is employed movement of the carriage in carriage return direction is not transmitted to the ribbon drive. Such one-way clutches however require a certain amount of movement before engagement and disengagement and these delays can affect synchronous movement of ribbon and carriage with the result that relative movement of ribbon and paper can occur during printing. A particular disadvantage of a one-way clutch resides in that ribbon advance will also occur during tabulating movements of the carriage and thus unused ribbon will be wasted.

U.S. Pat. No. 4,329,079 to Appelgate et al discloses a thermal printing typewriter having a printhead pivotally supported on a movable carriage and having a carriage supported ribbon system which is advanced during carriage movement by rotation of a capstan on the carriage in reaction to carriage movement relative to a frame supported cable. Capstan rotation is connected to drive the ribbon via a one-way clutch. As noted above the use of a oneway clutch wastes unused ribbon during tabulating carriage movement.

U.S. Pat. No. 4,300,844 to Keil discloses a thermal print head for printing directly on thermo sensitive paper. The print head is hingedly mounted on a carriage and spring biased toward a platen.

In accordance with the invention disadvantages attendant to prior art thermal typewriters are overcome in the provision of a carriage supported thermal print head mounting assembly of low mass capable of being easily moved relative to the carriage toward a platen to exert controlled pressure thereagainst, a carriage supported ribbon system adapted to advance ribbon incident to carriage movement when a clutch is engaged, and a control means operable in response to a print command to simultaneously move said printhead in pressure contact with said platen and to engage said clutch.

A feature of the invention resides in a printhead which is hingedly mounted on and biased toward a support which in turn is pivotally mounted on a carriage and biased in a direction to move the printhead away from a platen. The support is pivoted by an electromagnet driven lever to bring the printhead thereon against the platen; the lever acting simultaneously to effect engagement of a play free clutch thereby to couple carriage movement to ribbon take-up means whereby ribbon is advanced in an amount exactly corresponding to carriage movement but in the opposite direction with the result that the ribbon is not moved relative to the platen during printing. As the print head and clutch are respectively moved and engaged by print commands, the carriage may be moved in tabulate direction without feeding ribbon in the absence of a print command signal.

An object of the invention is in the provision of a low mass thermal print head assembly easily movable into pressure contact with a platen.

Another object of the invention is in the provision of a control system operable on command to simultaneously press a printhead against a platen and to engage a clutch adapted when engaged to couple carriage movement to ribbon advance means.

Another object of the invention is to provide a simple and reliable printhead assembly essentially of low mass, low cost plastic parts together with simple controls therefor.

Other objects, features and advantages of the present invention will become better known to those skilled in the art from a reading of the following detailed description when taken in conjunction with the accompanying drawing wherein like reference numerals designate like or corresponding elements throughout the several views thereof and wherein:

The single FIGURE of the drawing is a perspective view with parts exploded showing the print head assembly, and the control for moving the printhead assembly and for engaging a clutch for advancing ribbon in accordance with the invention.

Referring now to the drawing a carriage 1, shown in dotdashed lines, is mounted on guide rails 3 and 4 for movement parallel to a writing line defined by a platen 5 in escapement or printing and carriage return directions by means of a cable 2. As will be understood the cable 2 is pivotally trained about guide rollers and is adapted to be driven by a motor (not shown) in a manner known to the art.

An electromagnet 6, which has an axially displaceable armature 7 is secured on carriage 1. The armature is joined to one arm 8 of a two-arm control lever 9 which is mounted on carriage 1 for pivotal movement about a pin 10. The other arm 11 of control lever 9 has at its end a mouth-type opening 12 which embraces a vane 13 of a rocker 15 pivoted on a carriage supported axle 14. At an angle of 90° to vane 13 the rocker 15 extends in the direction of platen 5 and its end defines a fork 16.

Arm 8 of control lever 9 is provided with a depending lug 17 from which a connecting rod 18 leads to a support plate 19 which is itself pivotally mounted on a carriage supported axle 20. A spring 21 secured on support plate 19 tends to turn support plate 19 clockwise, as viewed in the FIGURE, away from platen 5.

Support plate 19 is provided with lugs 22 for receiving an axle 23 for an arm 24 whose upper end carries a thermal print head 25. Arm 24 has a bore 26 through which a screw 27 extends and is screwed into support plate 19. The diameter of bore 26 is greater than the diameter of the screw and is so selected that screw 27 will not contact the bore 26 unless arm 24 turns relative to support plate 19 beyond a predetermined angle. A helical compression spring 28 is mounted about screw 27 during assembly and is held compressed between the head of the screw and arm 24 thereby to normally adjustably urge arm 24 against support plate 19 in the direction of platen 5.

Carriage 1 also rotatably mounts a vertical shaft 29 which is non-rotatably connected to a cable drum 30 about which a few turns of a cable 31 is wound with the ends of cable 31 secured to left and right machine side frames (not shown). An additional wheel 32 is secured as by a key 33 to shaft 29 for rotation with and for axial displacement relative to shaft 29. An annular groove 34 in wheel 32 is provided and is embraced by the fork 16 on rocker 15. The upper end of wheel 32 is formed with toothed cone 35 which when wheel 32 is elevated by rocker 15 engages a toothed counter-cone in a hollow cylinder 37 suitably rotatably supported on the carriage 1. Wheel 32 with cone 35 and hollow cylinder 37 together form a disengageable clutch 38. An extension 39 of hollow cylinder 37 has a slot which serves to receive a connecting piece 40 associated with a feed roller or with a take-up spool in a ribbon cartridge 41. Extension 39 can pass, e.g. through a hole 42 in a plate 43 forming part of the carriage for supporting ribbon cartridge 41. Ribbon cartridge 41 can be secured in known manner on carriage plate 43.

As long as electromagnet 6 is not energized as by a print command signal, thermal print head 25 does not bear on platen 5 or on the ribbon interposed therebetween. Thus when the machine is turned off or when a carriage return, tabulate, line space and, if necessary, a letter space function is commanded by the electronic system of the machine, electromagnet 6 will not be energized.

With electromagnet 6 de-energized, spring 21 pulls support plate 21 and arm 24 away from platen 5 so that the thermal print head 25 does not bear on it. In this spring retracted position, the surface of arm 24 facing platen 5 bears on the opposing surface of support plate 19. Also, control lever 9 keeps rocker 15 in a rotated position in which fork 16 maintains wheel 32, and thus cone 35 out of engagement with counter-cone 36. Clutch 38 is thus open. Should a non-printing carriage movement takes place while clutch is open, e.g., a carriage return or tabulate movement, shaft 29 and wheel 32 will be turned by means of cable 31 and cable drum 30, but since clutch 38 is open, the rotation will not be transmitted to hollow cylinder 37 and thus to ribbon cartridge 41. Thus, during tabulating movement, for example, the ribbon will not be used up unnecessarily.

When a character print command issues in response to a keyboard signal the electronic system of the machine will cause electromagnet 6 to be energized, the carriage drive motor to be energized and selected elements of the thermal print head to be heated. Energization of electromagnet 6 will cause armature 7 to move in the direction of arrow A, in turn, causing control lever to move counterclockwise. This movement of lever 9, acting through connecting rod 1, turns support plate 19 against the action of spring 21 toward the platen 5 carrying arm 24 also toward platen 5 thereby causing thermal printhead 25 on arm 24 to encounter and bear against the platen 5 through an interposed ribbon and record medium. In so doing arm 24, due to the clearance between the bore 26 and screw 27, will rotatably yield and separate from support plate 19 compressing spring 28. Spring 28 thus ensures that thermal printhead 25 always bears with the same pressure, as adjusted by screw 27, on platen 5 independent of electromagnet 6 and acts to absorb any overstroke of support plate 19.

Movement of control lever 9 simultaneously turns rocker 15 clockwise thereby to elevate cone 35 into engagement with countercone 36 for transmitting carriage movement initiated by a print command to advance ribbon.

As the carriage moves to the right in arrow direction B to thereby effect column serial printing in response to a character print command, cable 31 will cause cable drum 30 to rotate counterclockwise and, since clutch 38 is engaged, the ribbon take-up spool will be driven to advance ribbon opposite direction B by the same amount as carriage advance. The result is that there is no relative movement between the ribbon and the platen (and paper supported thereby) during relative movement of the print head and ribbon as would cause streaking of print on the paper. During tabulation and carriage return the electromagnet 6 is not energized and the ribbon feed clutch is not engaged. Thus there is no relative movement between the ribbon and typehead during these carriage movements.

The control of clutch 38 in dependence on the operating or non operating position of printhead 25 enables a simple design and ensures reliable operation. Since only relatively small masses have to be moved over short distances, a relatively weak electromagnet 6 is sufficient.

The invention claimed is:

1. In a typewriter having a platen, a carriage moveable relative to said platen incident to typing commands, and a thermal print head supported on said carriage for movement into pressure contact with said platen, said print head support comprising a support plate pivotally mounted on said carriage for movement toward and away from said platen, a spring normally biasing said support plate in a direction away from said platen, an arm pivotally mounted on the side of said support plate facing away from the platen, said arm carrying said thermal print head, and resilient means connected to normally bias said arm against the side of said support plate facing away from said platen whereby said arm will follow movement of said support plate toward said platen and will yield and separate from said support plate upon encounter of said print read with said platen, and control means on said carriage responive to printing commands for moving said support plate toward said platen whereby said print head is pressed into resilient contact with said platen.

2. In a typewriter as recited in claim 1, said control means including an electromagnet, a lever pivotally mounted on said carriage and operable by the armature of said electromagnet, and a rod connecting said lever to said support plate from moving it toward said platen.

3. In a typewriter as recited in claim 1, said resilient means comprising a bore in said arm, a headed bolt extending through said bore and threaded into said support plate, and a compression spring mounted on said bolt between said support plate, said bore and bolt having diameters which will allow movement of said arm relative to said bolt when the thermal print head on the said arm encounters said platen incident to movement of said support plate toward said platen.

4. In a typewriter as recited in claim 2, including a thermal ribbon cartridge mounted on said carriage and means for advancing ribbon relative to said thermal print head, means on said carriage driven incident to movement of said carriage, and clutch means operable when engaged to couple said carriage driven means to said means for advancing ribbon, said control means including means for engaging said clutch in response to movement of said lever by said electromagnet.

5. In a typewriter as recited in claim 4, said clutch comprising a cone clutch.

* * * * *